US005137404A

United States Patent [19]

Mautino

[11] Patent Number: 5,137,404

[45] Date of Patent: Aug. 11, 1992

[54] CASTABLE PEDESTAL-TYPE SUPPORT APPARATUS FOR A CARGO SHIPPING CONTAINER

[75] Inventor: Peter S. Mautino, Verona

[73] Assignee: McConway & Torley Corporation, Pittsburgh, Pa.

[21] Appl. No.: 670,298

[22] Filed: Mar. 15, 1991

[51] Int. Cl.[5] ..... B61D 17/00

[52] U.S. Cl. ..... 410/72; 410/73

[58] Field of Search ..... 410/70, 71, 72, 73, 410/82, 83, 84, 90, 91, 44, 52, 54, 68, 76, 74, 75

[56] References Cited

U.S. PATENT DOCUMENTS

| | | | |
|---|---|---|---|
| 3,321,162 | 5/1967 | Connerat | 410/73 |
| 3,547,048 | 12/1970 | Miller | 410/73 |
| 3,556,449 | 1/1971 | Connerat et al. | 410/73 |
| 3,716,268 | 2/1973 | Arrey | 410/72 |
| 3,805,709 | 4/1974 | Schuller et al. | 410/73 X |
| 4,131,071 | 12/1978 | Glassmeyer | 410/83 X |
| 4,236,853 | 12/1980 | Niggemeier et al. | 410/76 |
| 4,430,032 | 2/1984 | Morgan | 410/68 |
| 4,597,701 | 7/1986 | DeWitt | 410/77 |
| 4,758,123 | 7/1988 | Corompt | 410/83 X |
| 4,826,371 | 5/1989 | Brown | 410/72 X |
| 4,844,672 | 7/1989 | Yurgevich | 410/54 |

*Primary Examiner*—Frank E. Werner
*Assistant Examiner*—James Eller
*Attorney, Agent, or Firm*—James Ray & Associates

[57] ABSTRACT

The present invention provides a castable pedestal-type support apparatus which supports a cargo shipping container on a transportation vehicle in a position to be secured thereto by a particular style locking mechanism. Such apparatus includes a body portion with a pivot pin receiving portion extending outwardly from a portion of an outer surface of each of a pair of side wall portions of such body portion. An aperture is formed through the pivot pin receiving portion. The apparatus further includes a box-like member formed at one end of the body portion to receive a locking mechanism therein. There is a counterweight disposed at the other end of the body portion to provide a minimal force being required to pivot the apparatus from an inoperative container supporting position into an operative container supporting position.

20 Claims, 2 Drawing Sheets

CASTABLE PEDESTAL-TYPE SUPPORT APPARATUS FOR A CARGO SHIPPING CONTAINER

FIELD OF THE INVENTION

The present invention relates, in general, to pedestal-type supports used to support a cargo shipping container on a generally flat bottom-type transportation vehicle in a position to be secured thereto by a particular style cargo shipping container locking mechanism and, more particularly, this invention relates to a pedestal-type support apparatus which can be cast as an integral single piece unit.

BACKGROUND OF THE INVENTION

Prior to the present invention, it was well known that cargo shipping containers have been supported on and connected to railway-type flat cars, flat bed trucks, as well as other lading-type transport vehicles such as ocean going vessels. The equipment that was normally used as supporting members for these shipping containers usually consisted of pedestals which were manually adjustable along the length of the deck portion of the particular transport vehicle being used. The manual adjustment required normally will depend upon the overall length of the shipping container to be supported.

However, because the locking mechanisms that have been used to secure such shipping containers to the support pedestals are supplied by different manufacturers, such support pedestals will not work with each style locking mechanism that is presently available for use, in this particular application, in the transportation industry. Even though such pedestals normally support these shipping containers adjacent the corners, there are specific operating conditions that can be encountered in which additional support is required. Consequently, such pedestals have been used to support such shipping containers intermediate the ends thereof as well as at their corners.

As is generally well known in the art, such cargo shipping containers can be of various lengths and shapes. If, for example, these cargo shipping containers are to be used at sea, then they may require a special shape.

In addition, the flat bottom-type vehicles used for transporting these shipping containers over land have, in most cases, been adapted to carry more than one such shipping container, for example, such shipping containers may be stacked two high on such vehicles in certain instances. This is particularly the case, for example, in the railway industry. In fact, in this industry rail cars have been specifically designed for use in this particular application. One example of a pedestal-type cargo shipping container locking device and support is taught in U.S. Pat. No. 4,430,032. Another example is taught in U.S. Pat. No. 4,597,701 and still another example is taught in U.S. Pat. No. 4,844,672.

Taught in U.S. Pat. No. 4,430,032 is a cargo shipping container retaining apparatus specifically designed for a transporting vehicle having a flat deck. This particular retaining apparatus requires that such shipping container have a corner fitting disposed on at least each of the four corners thereof. Furthermore, these corner fittings are required to be in substantially the same horizontal plane. As shown in this reference, these corner fittings include a slot-like portion which receives a latch lever therein for locking the shipping container to the deck portion of the transport vehicle. A separate support pedestal is provided in order to releasably support each corner of such shipping container. The support pedestal includes a frame member having a base portion, a platform portion spaced above such base portion, and end and side wall portions extending vertically of such platform portion and conforming to a corner fitting as the shipping container is lowered onto the platform portion. At least one of the side wall portions includes a slot-like portion formed therein. Such slot-like portion extends vertically along such at least one side wall portion. A latch lever extends along the slot-like portion between parallel walls which form such slot-like portion. Also provided in this retaining apparatus is a variable pivot for the latch lever. Such variable pivot enables pivoting such latch lever between the parallel walls of the slot-like portion. In this manner, the latch lever can move into such slot-like portion and into latching engagement with an associated corner fitting disposed on such shipping container. The latch lever has an inwardly extending upper end portion. This upper end portion includes an upwardly facing strike surface. The lower end portion of such latch lever extends a substantial distance beneath the platform. This device also includes a compression spring that engages the lower end portion of the latching lever. Such compression spring is provided to bias the latching lever to engage the strike surface with a corner fitting as the shipping container is lowered onto such platform. The compression spring has a moveable seat member disposed adjacent the lower end of the latching lever and a saddle member disposed on the end that is opposite the moveable seat member. Such saddle member being adjacent the lower end portion of the latch lever. A stationary seat member is provided at the outermost end of such compression spring. The saddle member is positioned for bearing engagement with the lower end portion of the latching lever. The moveable seat member for the compression spring includes a leg portion which extends along the compression spring for at least a portion of the length thereof and a lock bar member engageable with such leg portion. Such lock bar member reacts against the moveable seat member and an adjacent wall defining a slot. In this manner, compression of the spring is prevented and thereby securely locking the latch lever from accidentally moving to an undesired release position during service is achieved.

Taught in U.S. Pat. No. 4,597,701 is a fastener device for engagement with a corner casting of a cargo shipping container to secure such shipping container to a flat support of a transport vehicle. As taught therein, this corner casting is hollow and has a planar surface abutting and parallel to such flat support of the transport vehicle. This fastener device includes a hook member that is adapted to penetrate an aperture defined through such planar surface and a pivot means for coupling such hook member to the flat support.

Such pivot means being moveable parallel to the planar surface relative to the flat support. This arrangement enables movement of the hook member from a first position located outside the corner casting disposed on such shipping container to a second position of penetration of the corner casting. In this manner, locking a wall of the corner casting between the hook member and the flat support is achieved. Additionally, such pivot means maintains a constant spacial interval from a pivot point to the planar surface during all positions of penetration of the hook member into such aperture. As a result, during operation, such moveable pivot means allows the point of attack of the hook member penetrating into such aperture to be varied in a manner to match the position and orientation of the aperture. Such penetration of the aperture by the hook member is achieved without towards and away movement of the pivot point from such planar surface.

U.S. Pat. No. 4,844,672 teaches a wide body type shipping container that is attached for engagement with certain wide body shipping container support mechanisms on various types of transport vehicles. This is accomplished by providing a plurality of adapters moveably mounted with respect to supporting points disposed on the bottom portion of the wide body shipping containers. Each such adapter is moveable to a position beneath the shipping container supporting point and is engageable therewith in a manner that defines a new supporting structure. This new supporting structure is spaced laterally inward from the outermost surface of the wide body shipping container so as to permit coupling of the wide body shipping container to a standard width container support.

SUMMARY OF THE INVENTION

The instant invention provides a castable pedestal-type support apparatus. Such apparatus being used for supporting a cargo shipping container on a generally flat bottom-type transportation vehicle in a position to be secured thereto by a particular style cargo shipping container locking mechanism. Such castable pedestal-type support apparatus comprising a body portion having a predetermined configuration. The body portion further having each of a predetermined overall length, a predetermined overall width and a predetermined overall depth. Engaged with such body portion is a pivot pin receiving portion. The pivot pin receiving portion has each of a predetermined configuration and a predetermined length. In addition, such pivot pin receiving portion extends outwardly for a predetermined distance from a predetermined portion of an outer surface of each of a pair of side wall portions forming a part of the body portion. There is a generally round aperture, having a predetermined diameter, formed through such pivot pin receiving portion along a longitudinal axis thereof. At a first end of such body portion, a box-like member is provided. Such box-like member receives therein at least a portion of such particular style cargo shipping container locking mechanism. The box-like member includes a pair of side wall portions. In an axially opposed relationship, there is a bulb-like cut-out portion formed through each of such pair of side wall portions. These bulb-like cut-out portions have each of a generally circular portion and a slot-like portion. Such generally circular portion has a predetermined diameter. The slot-like portion is disposed between an outer periphery of the generally circular portion and an outer edge of a respective one of such pair of side wall portions. Also, such slot-like portion has a predetermined width which is less than such predetermined diameter of the generally circular portion of such bulb-like cut-out portion. Another wall portion is disposed intermediate a portion of an inner surface of such side wall portions adjacent an outer edge. This wall portion being a top wall when such castable pedestal-type support apparatus is in an inoperative cargo shipping container supporting position and a side wall portion when the pedestal-type support apparatus is in an operative cargo shipping container supporting position. The final required element of the box-like member is a generally rectangular box-like member which is disposed between another portion of such inner surface of the side wall portions adjacent a corner of such box-like member and a bottom surface when the pedestal-type support apparatus is in such inoperative cargo shipping container supporting position. The last essential element of such pedestal-type support apparatus is a counterweight means. Such counterweight means is disposed at an axially opposed second end of the body portion. This counterweight means provides a predetermined force that will be required to pivot such pedestal-type support apparatus from such inoperative cargo shipping container supporting position into such operative cargo shipping container supporting position on such flat bottom-type transportation vehicle.

OBJECTS OF THE INVENTION

It is, therefore, one of the primary objects of the present invention to provide an improved cargo shipping container pedestal-type support apparatus which can be cast as an integral single piece unit.

Still another object of the present invention is to provide an improved cargo shipping container pedestal-type support apparatus which is relatively lightweight.

Yet another object of the present invention is to provide an improved cargo shipping container pedestal-type support apparatus which requires a minimal amount of force to pivot from an inoperative cargo shipping container supporting position into an operative cargo shipping container support position.

A further object of the present invention is to provide an improved cargo shipping container pedestal-type support apparatus which, during the useful life thereof, is essentially maintenance free.

An additional object of the present invention is to provide an improved cargo shipping container pedestal-type support apparatus which requires a minimum amount of machining.

Still yet another object of the present invention is to provide an improved cargo shipping container pedestal-type support apparatus which is relatively inexpensive to manufacture.

Yet still another object of the present invention is to provide an improved cargo shipping container pedestal-type support apparatus which is relatively simple to install.

A still further object of the present invention is to provide a cargo shipping container pedestal-type support apparatus which can be retrofitted to existing flat bottom-type transportation vehicles.

It is an additional object of the present invention to provide an improved cargo shipping container pedestal-type support apparatus which does not require any special installation tools.

In addition to the above-described objects and advantages of the improved castable cargo shipping container pedestal-type support apparatus, various other objects and advantages of the present invention will become more readily apparent to those persons who are skilled in the cargo shipping container pedestal-type support art from the following more detailed description of the invention, particularly, when such description is taken in conjunction with the attached drawing figures and with the appended claims.

DESCRIPTION OF THE VARIOUS EMBODIMENTS OF THE INVENTION

Figure 1:
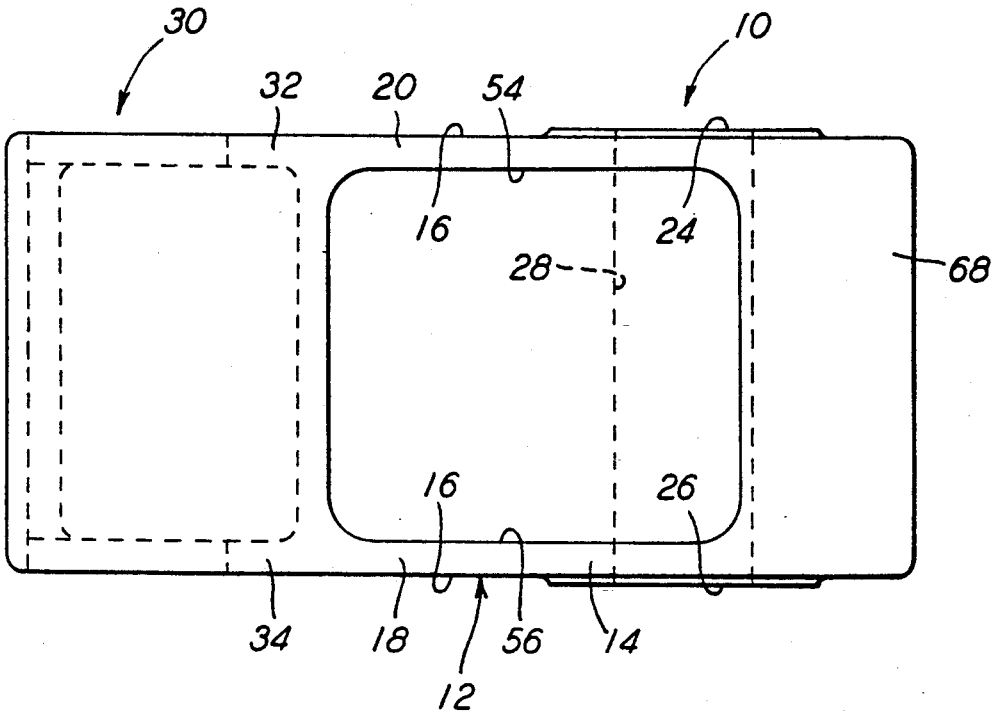
FIG. 1 is a top view of a presently preferred embodiment of a pedestal-type support apparatus for a cargo shipping container produced according to the present invention.

Prior to proceeding to a more detailed description of the cargo shipping container pedestal-type support apparatus, it should be noted that throughout the several views, illustrated in the attached drawings, identical components which have associated therewith identical functions have been identified with identical reference numerals for the sake of clarity.

Figure 2:
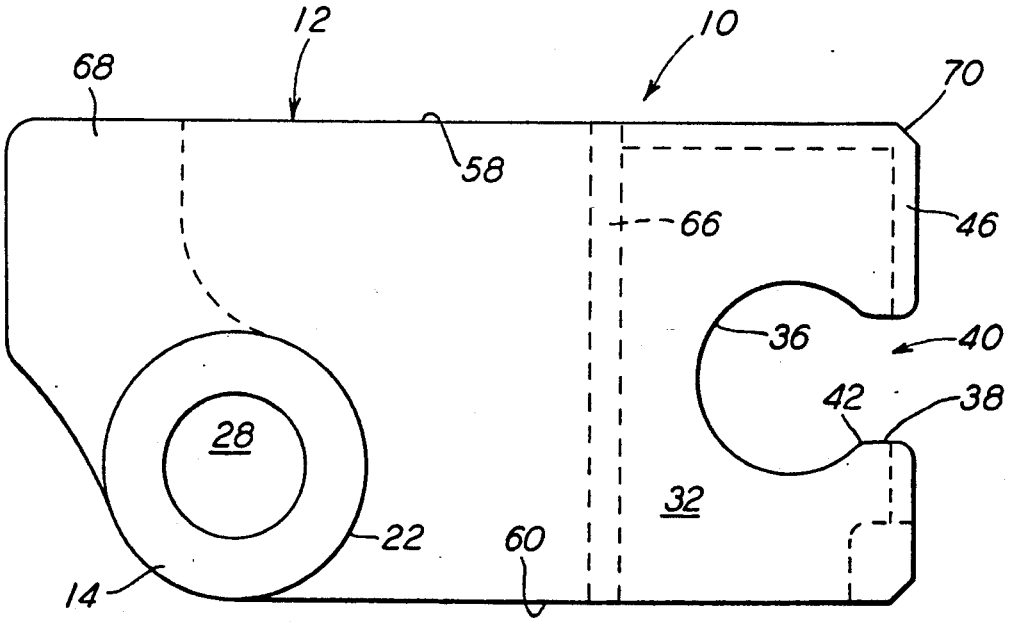
FIG. 2 is a cross sectional side elevation view taken along lines II—II of the cargo shipping container pedestal-type support apparatus of the present invention illustrated in FIG. 1.
Figure 3:
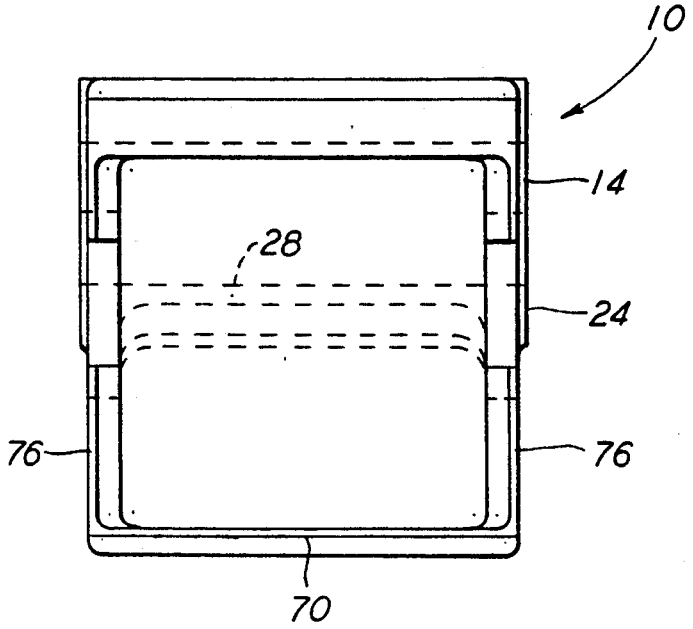
FIG. 3 is an end view of the cargo shipping container pedestal-type support apparatus of the present invention illustrated in FIGS. 1 and 2.

Now refer, more particularly, to FIGS. 1-3. Illustrated therein is a castable pedestal-type support apparatus. Such support apparatus 10 supports a cargo shipping container (not shown) on a generally flat bottom-type transportation vehicle (not shown) in a predetermined position to enable securing such shipping container to such transportation vehicle by a particular style cargo shipping container locking mechanism (not shown). This particular support apparatus 10 is designed for use with a cargo shipping container locking mechanism manufactured by Portec, Inc.

The castable pedestal-type support apparatus 10 comprises a body portion 12 having a predetermined configuration.

Such body portion 12 further having each of a predetermined overall length, a predetermined overall width and a predetermined overall depth. In the presently preferred embodiment of the invention, such predetermined overall length of the body portion 12 will generally be between about 14.781 inches and about 14.719 inches. Further, such predetermined overall width of the body portion 12 will generally be between about 6.969 inches and about 7.031 inches. In addition, the predetermined overall depth of such body portion 12 will preferably be between about 7.599 inches and about 7.661 inches.

The support apparatus 10 also includes a pivot pin receiving portion 14. Such pivot pin receiving portion 14 having each of a predetermined length and a predetermined configuration. The pivot pin receiving portion 14 extends outwardly for a predetermined distance from a predetermined portion of an outer surface 16 of each of a pair of side wall portions 18 and 20 of such body portion 12. In the presently preferred embodiment of the invention, such predetermined distance the pivot pin receiving portion 14 extends outwardly from such portion of the outer surface 16 of such each of the pair of side wall portions 18 and 20 of the body portion 12 will generally be between about 0.125 inch and about 0.141 inch. Also, the predetermined configuration of such pivot pin receiving portion 14 will preferably include a generally arcuate portion 22. Additionally, in this embodiment, each end 24 and 26 of such pivot pin receiving portion 14 will have a machined surface. Further, the generally arcuate portion 22 of such pivot pin receiving portion 14 will have an outer diameter that will generally be between about 4.0 inches and about 4.5 inches.

A generally round aperture 28 having a predetermined diameter is formed through such pivot pin receiving portion 14 along a longitudinal axis thereof. Preferably, such predetermined diameter of the generally round aperture 28 will generally be between about 2.260 inches and about 2.275 inches.

There is a box-like member, generally designated 30, formed at a first predetermined end of such body portion 12. Such box-like member 30 is provided to receive at least a portion of the cargo shipping container locking mechanism therein. Such box-like member 30 includes a pair of side wall portions 32 and 34. A bulb-like cut-out portion, generally designated 40, is formed in an axially opposed relationship through each of such pair of side wall portions 32 and 34. Such bulb-like cut-out portion 40 having each of a generally circular portion 36 and a slot-like portion 38 disposed between an outer periferee 42 of such generally circular portion 36 and an outer edge 44 of a respective one of such pair of side wall portions 32 and 34. Such slot-like portion 38 having a predetermined width that is less than the predetermined diameter of such generally circular portion 36. A wall portion 46 is disposed intermediate a portion of an inner surface of each of such side wall portions 32 and 34 adjacent an outer edge 48. Such wall portion 46 being a top wall when such pedestal-type support apparatus 10 is in an inoperative cargo shipping container supporting position and a side wall portion when such pedestal-type support apparatus 10 is in an operative cargo shipping container supporting position. The final essential element of the box-like member 30 is a generally rectangular bar-like member 50 disposed between another portion of such inner surface of each of the side wall portions 32 and 34 adjacent a corner of such box-like member 30 disposed at an outer edge of such box-like member 30 and a bottom surface 52 when such pedestal-type support apparatus 10 is in the inoperative cargo shipping container support position. As shown in FIGS. 1-4 in the presently preferred embodiment of the invention, such box-like member 30 will include a reinforcing wall portion 66 disposed between another portion of each inner surface of such pair of side wall portions 32 and 34 of the body portion 12 and substantially midway between such each outer longitudinal edge.

Figure 4:
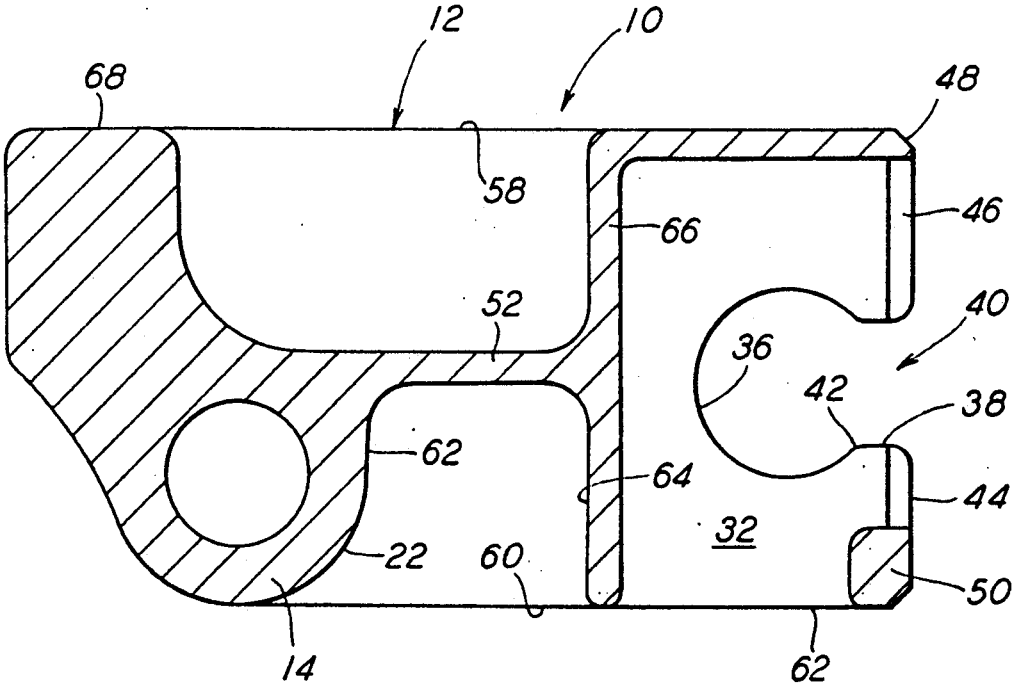
FIG. 4 is a side elevation view of an alternative embodiment of a cargo shipping container pedestal-type support apparatus of the present invention.

As best seen in FIG. 4, in the presently preferred embodiment of the invention, the castable pedestal-type support apparatus 10 further includes a reinforcing wall portion 52 disposed between another portion of each inner surface 54 and 56 of such pair of side wall portions 18 and 20 of the body portion 12. Such reinforcing wall portion 52 is located substantially midway between each outer longitudinal edge 58 and 60 of such pair of side wall portions 18 and 20 of the body portion 12. Such reinforcing wall portion 52 extends between a predetermined portion of an outer surface 62 of such pivot pin receiving portion 14 and a portion of a back surface 64 of a back wall portion 66 of the box-like member 30.

The final essential element of the pedestal-type support apparatus 10 is a counterweight means 68 for providing a predetermined force that will be required to pivot such pedestal-type support apparatus 10 from a inoperative cargo shipping container supporting portion into an operative cargo shipping container supporting portion on such flat bottom-type transportation vehicle. Such counterweight means 68 is disposed at an axially opposed second end of the body portion 12. In the presently preferred embodiment of the invention, such counterweight means 68 comprises a thickened wall section. Further, such predetermined force required to pivot such pedestal-type support apparatus from the inoperative cargo shipping container supporting position into such operative cargo shipping container supporting position will generally be less than about 65 pounds and, more preferably, such predetermined force will generally be less than about 50 pounds.

According to the present invention, at least the body portion 12, the pivot pin receiving portion 14, the box-like member 30 and such counterweight means 68 will be cast as a integral single piece unit. Preferably, at least a portion of such generally round aperture 28 in such pivot pin receiving portion 14 will be simultaneously cast in the pedestal-type support apparatus 10. In the preferred embodiment, a single diameter of such generally round aperture 28 cast in such pivot pin receiving portion 14 will be achieved by machining.

The generally circular portion 36 of such bulb-like cut-out portion 40 has a radius of generally between about 1.5 inches and about 1.55 inches in the preferred embodiment of the invention and the predetermined width of such slot-like portion 38 of the bulb-like cut-out portion 40 will generally be between about 1.5 inches and about 2.0 inches. Finally, in the most preferred embodiment of the invention, such box-like member 30 will include a chamfered portion 70 adjacent each outer edge thereof.

While a number of presently preferred and alternative embodiments of the castable pedestal-type support apparatus have been described in detail above, it should be noted obvious to those persons who are skilled in the cargo shipping container support and locking art that various other modifications and adaptations of the present invention can be made without departing from the spirit and scope of the appended claims.

I claim:

1. A castable pedestal-type support apparatus for supporting a cargo shipping container on a generally flat bottom-type transportation vehicle in a position to be secured thereto by a cargo shipping container locking mechanism, said castable pedestal-type support apparatus comprising:

(a) a body portion having a predetermined configuration, said body portion further having each of a predetermined overall length, a predetermined overall width and a predetermined overall depth;

(b) a pivot pin receiving portion having each of a predetermined length and a predetermined configuration, said pivot pin receiving portion extending outwardly a predetermined distance from a predetermined portion of an outer surface of each of a pair of side wall portions of said body portion;

(c) a generally round aperture having a predetermined diameter formed through said pivot pin receiving portion along a longitudinal axis thereof;

(d) a box-like member formed at a first predetermined end of said body portion for receiving at least a portion of a cargo shipping container locking mechanism therein, said box-like member including;

(i) a pair of side wall portions, (ii) a bulb-like cut-out portion formed in an axially opposed relationship through each of said pair of side wall portions, said bulb-like cut-out portion having each of a generally circular portion of a predetermined diameter and a slot-like portion disposed between an outer periphery of said generally circular portion and an outer edge of a respective one of said pair of side wall portions, said slot-like portion having a predetermined width less than said predetermined diameter of said generally circular portion, (iii) a wall portion disposed intermediate a portion of an inner surface of said side wall portions adjacent an outer edge, said wall portion being a top wall when said pedestal-type support apparatus is in an inoperative cargo shipping container supporting position and a side wall portion when said pedestal-type support apparatus is in an operative cargo shipping container supporting position, and (iv) a generally rectangular bar-like member disposed between another portion of said inner surface of each of said side wall portions adjacent a corner of each of said side wall portions and adjacent a bottom surface of said box-like member when said pedestal-type support apparatus is in said inoperative cargo shipping container supporting position; and (e) a counterweight means disposed at an axially opposed second end of said body portion for providing a predetermined force that is required to pivot said pedestal-type support apparatus from said inoperative cargo shipping container supporting position into said operative cargo shipping container supporting position on such flat bottom-type transportation vehicle.

2. A castable pedestal-type support apparatus, according to claim 1, wherein at least said body portion, said pivot pin receiving portion, said box-like member and said counterweight means are cast as an integral single piece unit.

3. A castable pedestal-type support apparatus, according to claim 2, wherein at least a portion of said generally round aperture is simultaneously cast in said pivot pin receiving portion.

4. A castable pedestal-type support apparatus, according to claim 3, wherein a final diameter of said generally round aperture cast in said pivot pin receiving portion is achieved by machining.

5. A castable pedestal-type support apparatus, according to claim 4, wherein each end of said pivot pin receiving portion is machined.

6. A castable pedestal-type support apparatus, according to claim 2, wherein said predetermined configuration of said pivot pin receiving portion includes a generally arcuate portion.

7. A castable pedestal-type support apparatus, according to claim 6, wherein an outer diameter of said generally arcuate portion of said pivot pin receiving portion is generally between about 4.00 inches and about 4.50 inches.

8. A castable pedestal-type support apparatus, according to claim 7, wherein said predetermined diameter of said generally round aperture is generally between about 2.260 inches and about 2.275 inches.

9. A castable pedestal-type support apparatus, according to claim 8, wherein said predetermined distance which said pivot pin receiving portion extends outwardly from said portion of said outer surface of said each of said pair of side wall portions of said body portion is between about 0.125 inch and about 0.141 inch.

10. A castable pedestal-type support apparatus, according to claim 2, wherein said generally circular portion of said bulb-like cut-out portion has a radius of generally between about 1.45 inches and about 1.55 inches and said predetermined width of said slot-like portion of said bulb-like cut-out portion is generally between about 1.95 inches and about 2.05 inches.

11. A castable pedestal-type support apparatus, according to claim 1, wherein said castable pedestal-type support apparatus further includes a reinforcing wall portion disposed between another portion of each inner surface of said pair of side wall portions of said body portion and substantially midway between each outer longitudinal edge of said pair of side wall portions of said body portion, said reinforcing wall portion extending between a predetermined portion of an outer surface of said pivot pin receiving portion and a portion of a back surface of a back wall portion of said box-like member.

12. A castable pedestal-type support apparatus, according to claim 1, wherein said counterweight means is a thickened wall section.

13. A castable pedestal-type support apparatus, according to claim 12, wherein said predetermined force required to pivot said pedestal-type support apparatus from said inoperative cargo shipping container supporting position into said operative cargo shipping container supporting position is generally less than about 65 pounds.

14. A castable pedestal-type support apparatus, according to claim 13, wherein said predetermined force required to pivot said pedestal-type support apparatus from said inoperative cargo shipping container supporting position into said operative cargo shipping container supporting position is generally less than about 50 pounds.

15. A castable pedestal-type support apparatus, according to claim 1, wherein said generally circular portion of said bulb-like cut-out portion has a radius of generally between about 1.45 inches and about 1.55 inches.

16. A castable pedestal-type support apparatus, according to claim 15, wherein said predetermined width of said slot-like portion of said bulb-like cut-out portion is generally between about 1.95 inches and about 2.05 inches.

17. A castable pedestal-type support apparatus, according to claim 1, wherein said predetermined overall length of said body portion is generally between about 14.781 inches and about 14.719 inches.

18. A castable pedestal-type support apparatus, according to claim 17, wherein said predetermined overall width of said body portion is generally between about 6.969 inches and 7.031 inches.

19. A castable pedestal-type support apparatus, according to claim 18, wherein said predetermined overall depth of said body portion is generally between about 7.599 inches and about 7.661 inches.

20. A castable pedestal-type support apparatus, according to claim 1, wherein said box-like member includes a chamfered portion adjacent each outer edge thereof.

* * * * *